US011685962B2

(12) United States Patent
Han et al.

(10) Patent No.: US 11,685,962 B2
(45) Date of Patent: Jun. 27, 2023

(54) ANNEALING SEPARATOR COMPOSITION FOR GRAIN-ORIENTED ELECTRICAL STEEL SHEET, GRAIN-ORIENTED ELECTRICAL STEEL SHEET, AND METHOD FOR MANUFACTURING GRAIN-ORIENTED ELECTRICAL STEEL SHEET

(71) Applicant: POSCO, Pohang-si (KR)

(72) Inventors: Min Soo Han, Pohang-si (KR); Yunsu Kim, Pohang-si (KR); Jong-Tae Park, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 17/280,528

(22) PCT Filed: Sep. 25, 2019

(86) PCT No.: PCT/KR2019/012469

§ 371 (c)(1),
(2) Date: Apr. 29, 2021

(87) PCT Pub. No.: WO2020/067719

PCT Pub. Date: Apr. 2, 2020

(65) Prior Publication Data

US 2022/0042125 A1 Feb. 10, 2022

(30) Foreign Application Priority Data

Sep. 27, 2018 (KR) ..... 10-2018-0115270

(51) Int. Cl.
*C21D 8/12* (2006.01)
*C21D 1/70* (2006.01)

(52) U.S. Cl.
CPC ..... *C21D 8/1283* (2013.01); *C21D 1/70* (2013.01); *C21D 8/1222* (2013.01); *C21D 8/1233* (2013.01)

(58) Field of Classification Search
CPC ... C21D 1/68; C21D 1/70; C21D 1/72; C21D 8/12
See application file for complete search history.

(56) References Cited

U.S. PATENT DOCUMENTS 2,906,645 A * 9/1959 Carpenter ..... C23C 24/00 427/126.3
3,956,030 A * 5/1976 Lee ..... C23C 24/00 148/636

(Continued)

FOREIGN PATENT DOCUMENTS

CN 101528950 A 9/2009
CN 108474054 A 8/2018

(Continued)

OTHER PUBLICATIONS

International Search Report and Written Opinion issued in corresponding International Application No. PCT/KR2019/012469 dated Jan. 10, 2020, with partial English translation.

(Continued)

*Primary Examiner* — Vanessa T. Luk
(74) *Attorney, Agent, or Firm* — Morgan, Lewis & Bockius LLP

(57) ABSTRACT

An annealing separator composition for a grain-oriented electrical steel sheet according to an embodiment of the present invention includes: 100 parts by weight of at least one of a magnesium oxide and a magnesium hydroxide; and 30 to 250 parts by weight of a metal hydroxide including at least one of a nickel hydroxide and a cobalt hydroxide, wherein an average particle diameter of the metal hydroxide is 0.01 to 80 μm.

6 Claims, 4 Drawing Sheets

(56) References Cited

U.S. PATENT DOCUMENTS

| | | | | |
|---|---|---|---|---|
| 2010/0279142 | A1* | 11/2010 | Ushigami | C22C 38/08 428/612 |
| 2018/0371576 | A1* | 12/2018 | Park | C21D 8/1261 |
| 2019/0010572 | A1 | 1/2019 | Han et al. | |
| 2020/0283863 | A1* | 9/2020 | Senda | C21D 8/1244 |

FOREIGN PATENT DOCUMENTS

| | | | | |
|---|---|---|---|---|
| JP | H07-173642 | A | 7/1996 | |
| JP | H09-41153 | A | 2/1997 | |
| JP | 2005-200705 | A | 7/2005 | |
| JP | 2005-290445 | A | 10/2005 | |
| JP | 2014-201806 | A | 10/2014 | |
| JP | 2016-145419 | A | 8/2016 | |
| KR | 10-2013-0026243 | A | 3/2013 | |
| KR | 10-1296131 | B1 | 8/2013 | |
| KR | 10-2018-0072465 | A | 6/2018 | |
| KR | 10-2018-0072487 | A | 6/2018 | |
| KR | 10-2018-0073336 | A | 7/2018 | |
| WO | 2007/007417 | A1 | 1/2007 | |
| WO | 2013/051270 | A8 | 4/2013 | |
| WO | 2017/105112 | A1 | 6/2017 | |
| WO | 2018/117637 | A3 | 6/2018 | |
| WO | 2018/117673 | A1 | 6/2018 | |
| WO | WO-2019065645 | A1 * | 4/2019 | C21D 6/005 |

OTHER PUBLICATIONS

Indian Office Action dated Feb. 24, 2022 issued in Indian Patent Application No. 202137019224 (with English translation).

Japanese Office Action dated Mar. 8, 2022 issued in Japanese Patent Application No. 2021-517634.

* cited by examiner

ANNEALING SEPARATOR COMPOSITION FOR GRAIN-ORIENTED ELECTRICAL STEEL SHEET, GRAIN-ORIENTED ELECTRICAL STEEL SHEET, AND METHOD FOR MANUFACTURING GRAIN-ORIENTED ELECTRICAL STEEL SHEET

CROSS REFERENCE

This application is the U.S. National Phase under 35 U.S.C. § 371 of International Application No. PCT/KR2019/012469 filed on Sep. 25, 2019, which claims the benefit of Korean Patent Application No. 10-2018-0115270 filed on Sep. 27, 2018, the entire contents of each are hereby incorporated by reference.

TECHNICAL FIELD

An embodiment of the present invention relates to an annealing separator composition for a grain-oriented electrical steel sheet, a grain-oriented electrical steel sheet, and a grain-oriented electrical steel sheet manufacturing method. In particular, an embodiment of the present invention relates to an annealing separator composition for a grain-oriented electrical steel sheet for improving properties of a film by use of a nickel hydroxide and a cobalt hydroxide, and ultimately improving iron loss of a material, a grain-oriented electrical steel sheet, and a grain-oriented electrical steel sheet manufacturing method.

BACKGROUND ART

A grain-oriented electrical steel sheet represents a steel sheet containing a component of Si, and it indicates an electrical steel sheet with an excellent magnetic characteristic in a rolling direction as its grain orientation has a texture piece arranged in a direction of {110}<001>.

Recently, as the grain-oriented electrical steel sheet with high magnetic flux density is commercially available, a material with a less iron loss is required. To improve the iron loss of the electrical steel sheet, four technical methods are possible. The first one is a method for accurately orientating a grain orientation of {110}<001> including a magnetization axis of a grain-oriented electrical steel sheet in a rolling direction, the second one is a method for thinning the material, the third one is a method for refining magnetic domains according to a chemical and physical method, and a fourth one is a method for improving a surface physical property or providing a surface tension according to a chemical method such as a surface treatment and a coating.

Particularly, the improvement of a surface physical property or provision of a surface tension is proposed to the method for forming a primary film and an insulating film. As the primary film, a forsterite ($2MgO \cdot SiO_2$) layer generated by a reaction of a silicon oxide ($SiO_2$) generated on a material surface and a magnesium oxide (MgO) used as an annealing separator in a primary recrystallization annealing process of an electrical steel sheet material is known. The primary film formed during high temperature annealing must have a uniform color without defects on the appearance, and in a functional way, it may have an effect of improving the iron loss of the material by preventing fusion between plates in a coil state and providing a tensional stress to the material according to a difference of thermal expansion coefficients between the material and the primary film.

Recently, as demands on low iron loss grain-oriented electrical steel sheets are increased, high tensions on the primary film are pursued, and methods for controlling processing factors for improving a characteristic of a tension film are attempted so that a high-tension insulating film may substantially improve a magnetic characteristic of a final product. Conventionally, the tension applied to the material by a secondary insulation with a primary film or a tension coating is generally equal to or greater than 1.0 $kgf/mm^2$, and in this instance, tension gravity occupied by the respective same are around 50/50. Therefore, a film tension by the forsterite is about 0.5 $kgf/mm^2$, and when the film tension by the primary film is improved compared to the present state, the iron loss of the material may be improved and efficiency of a transformer may also be improved.

Regarding this, a method for obtaining a high-tension film by introducing a halogen compound to an annealing separator is proposed. A method for forming a mullite film with a low thermal expansion coefficient by applying an annealing separator with kaolinite as a major component is also proposed. Methods for reinforcing an interface adherence by introducing rare elements such as Ce, La, Pr, Nd, Sc, or Y are proposed. However, the annealing separator addition agent proposed by the above-noted methods is very expensive and has very low workability in applying to actual production processes. Particularly, when the material such as kaolinite is manufactured as slurry to be used to the annealing separator, its coating property is bad and is inadequate for functioning as an annealing separator.

The above information disclosed in this Background section is only for enhancement of understanding of the background of the invention, and therefore it may contain information that does not form the prior art that is already known in this country to a person of ordinary skill in the art.

DISCLOSURE

The present invention has been made in an effort to provide an annealing separator composition for a grain-oriented electrical steel sheet, a grain-oriented electrical steel sheet, and a grain-oriented electrical steel sheet manufacturing method.

In detail, an embodiment of the present invention provides an annealing separator composition for a grain-oriented electrical steel sheet having an excellent adhesion property and a film tension and improving an iron loss of a material, a grain-oriented electrical steel sheet, and a grain-oriented electrical steel sheet manufacturing method.

An embodiment of the present invention provides an annealing separator composition for a grain-oriented electrical steel sheet including: 100 parts by weight of at least one of a magnesium oxide and a magnesium hydroxide; and 30 to 250 parts by weight of a metal hydroxide including at least one of a nickel hydroxide and a cobalt hydroxide, wherein an average particle diameter of the metal hydroxide is 0.01 to 80 μm.

The metal hydroxide may include 30 to 250 parts by weight of the nickel hydroxide.

The metal hydroxide may include 30 to 150 parts by weight of the nickel hydroxide and 30 to 150 parts by weight of the cobalt hydroxide.

The annealing separator composition for a grain-oriented electrical steel sheet may further include 1 to 10 parts by weight of ceramic powder.

The ceramic powder may be at least one of $Al_2O_3$, $SiO_2$, $TiO_2$, and $ZrO_2$.

The annealing separator composition for a grain-oriented electrical steel sheet may further include 50 to 500 parts by weight of a solvent.

Another embodiment of the present invention provides a grain-oriented electrical steel sheet including a substrate of which on one side or respective sides, a film including at least one composite material of Fe—Ni, Fe—Co, and Fe—Ni—Co is formed.

Regarding the cross-section of the steel sheet in a thickness direction, an average particle diameter of at least one composite material of the Fe—Ni, Fe—Co, and Fe—Ni—Co may be 1 to 100 nm.

Regarding the cross-section of the steel sheet in a thickness direction, an occupying area of at least one composite material of the Fe—Ni, Fe—Co, and Fe—Ni—Co for the film area may be 0.1 to 10%.

The film may include 0.1 to 40 wt % of at least one of Ni and Co, 40 to 85 wt % of Mg, 0.1 to 40 wt % of Si, 10 to 55 wt % of O, and Fe as a remainder.

The film may further include a composite material of Mg—Si.

A thickness of the film may be 0.1 to 10 μm.

An oxidation layer may be formed into the substrate from an interface of the film and the substrate.

The oxidation layer may include at least one composite material of Fe—Ni, Fe—Co, and Fe—Ni—Co.

The grain-oriented electrical steel sheet substrate may include 2.0 to 7.0 wt % of silicon (Si), 0.020 to 0.040 wt % of aluminum (Al), 0.01 to 0.20 wt % of manganese (Mn), 0.01 to 0.15 wt % of phosphorus (P), equal to or less than 0.01 wt % of carbon (C) (excluding 0%), 0.005 to 0.05 wt % of N, and 0.01 to 0.15 wt % of antimony (Sb), tin (Sn), or a combination thereof, and a remainder may include Fe and other inevitable impurities.

Yet another embodiment of the present invention provides a method for manufacturing a grain-oriented electrical steel sheet including: preparing a steel slab; heating the steel slab; producing a hot rolled plate by hot rolling the heated steel slab; producing a cold-rolled steel sheet by cold rolling the hot rolled plate; performing a primary recrystallization annealing on the cold-rolled steel sheet; applying an annealing separator on a surface of the steel sheet having undergone the primary recrystallization annealing; and performing a secondary recrystallization annealing on the steel sheet on which the annealing separator is applied.

The annealing separator may include 100 parts by weight of at least one of a magnesium oxide and a magnesium hydroxide, and 30 to 250 parts by weight of a metal hydroxide including at least one of a nickel hydroxide and a cobalt hydroxide, and an average particle diameter of the metal hydroxide may be 0.01 to 80 μm.

The performing of a primary recrystallization annealing on the cold-rolled steel sheet may include simultaneously performing a decarburization annealing and a nitrification annealing on the cold-rolled steel sheet, or performing a nitrification annealing thereon after performing decarburization annealing.

According to the embodiment of the present invention, the grain-oriented electrical steel sheet with excellent iron loss and magnetic flux density and excellent adhesion property and insulating property of the film, and the manufacturing method thereof may be provided.

According to the embodiment of the present invention, nickel or cobalt is in the primary film, and some of the nickel or cobalt penetrates into the grain-oriented electrical steel sheet substrate to form a composite material of Fe—Ni, Fe—Co, and Fe—Ni—Co, so magnetization may be easily performed, and the grain-oriented electrical steel sheet with an improved iron loss particularly a radio-frequency iron loss, and a manufacturing method thereof.

MODE FOR INVENTION

Figure 1:
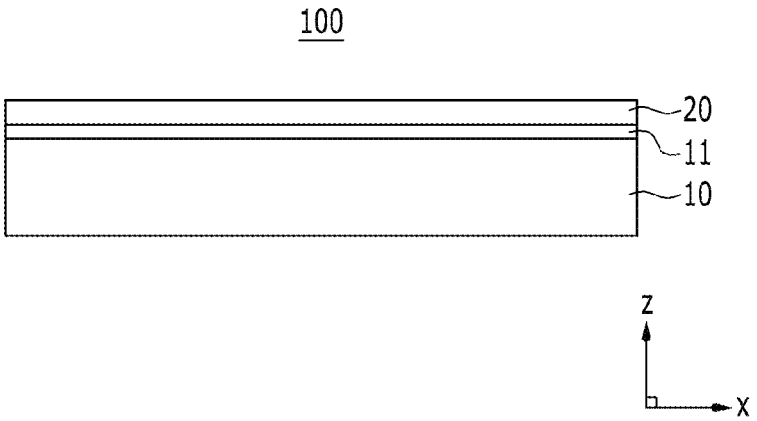
FIG. 1 shows a lateral cross-sectional view of a grain-oriented electrical steel sheet according to an embodiment of the present invention.

The technical terms used herein are to simply mention a particular embodiment and are not meant to limit the present invention. An expression used in the singular encompasses an expression of the plural, unless it has a clearly different meaning in the context. In the specification, it is to be understood that terms such as "including", "having", etc., are intended to indicate the existence of specific features, regions, numbers, stages, operations, elements, components, or combinations thereof disclosed in the specification, and are not intended to preclude the possibility that one or more other specific features, regions, numbers, operations, elements, components, or combinations thereof may exist or may be added.

When a part is referred to as being "on" another part, it can be directly on the other part or intervening parts may also be present. In contrast, when an element is referred to as being "directly on" another element, there are no intervening elements therebetween.

In the present invention, 1 ppm indicates 0.0001%.

When an additional component is further included in the composition including a remainder in an embodiment of the present invention, it means that the additional component replaces the remainder by an added amount of the additional component.

Unless otherwise defined, all terms used herein, including technical or scientific terms, have the same meanings as those generally understood by those with ordinary knowledge in the field of art to which the present invention belongs. Such terms as those defined in a generally used dictionary are to be interpreted to have the same meanings as contextual meanings in the relevant field of art, and are not to be interpreted to have idealized or excessively formal meanings unless clearly defined in the present application.

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

The annealing separator composition for a grain-oriented electrical steel sheet according to an embodiment of the present invention includes: 100 parts by weight of at least one of a magnesium oxide and a magnesium hydroxide; and 30 to 250 parts by weight of a metal hydroxide including at least one of a nickel hydroxide and a cobalt hydroxide. Here, the parts by weight signify a weight relatively contained for each component.

The annealing separator composition for a grain-oriented electrical steel sheet according to an embodiment of the present invention includes at least one of a nickel hydroxide ($Ni(OH)_2$) and cobalt hydroxide ($Co(OH)_2$) that are reactive materials in addition to the magnesium oxide (MgO) that is one of components of the conventional annealing separator composition. By adding the metal hydroxide as described, silica formed on the substrate surface and react to each other to form at least one composite material of Fe—Ni, Fe—Co, and Fe—Ni—Co, thereby easing magnetization and ultimately improving the iron loss of the grain-oriented electrical steel sheet. Particularly, a radio-frequency iron loss of the grain-oriented electrical steel sheet is improved.

At least one composite material from among Fe—Ni, Fe—Co, and Fe—Ni—Co, particularly, a permalloy thereof, generally has very high permeability in a low magnetic field. For this reason, in an embodiment of the present invention, the iron loss, particularly the radio-frequency iron loss, is improved by providing a magnetic property to the primary film. This effect allows manufacturing of a high-efficiency transformer with low power loss.

When a cold-rolled steel sheet passes through a heating furnace in control at a wet atmosphere for the purpose of primary recrystallization during a process for manufacturing a grain-oriented electrical steel sheet, Si with the highest steel oxygen affinity reacts with oxygen supplied from the vapor in the furnace to form $SiO_2$ on the surface. As oxygen permeates to the steel, a Fe-based oxide is produced. The $SiO_2$ formed in this way forms a forsterite ($Mg_2SiO_4$) layer according to a chemical reaction expressed in Reaction Formula 1 with a magnesium oxide or a magnesium hydroxide in the annealing separator.

$$2Mg(OH)_2+SiO_2 \rightarrow Mg_2SiO_4+2H_2O \quad \text{[Reaction Formula 1]}$$

That is, the electrical steel sheet having undergone the primary recrystallization annealing is coated with a magnesium oxide slurry as an annealing separator and undergoes secondary recrystallization annealing, that is, high temperature annealing, and in this instance, the material expanded by heat is contracted again when it is cooled but the forsterite layer generated on the surface hinders contraction of the material. When the thermal expansion coefficient of the forsterite film is very much less compared to the material, a residual stress ($\sigma_{RD}$) in the rolling direction may be expressed as follows.

$$\sigma_{RD}=2E_c\delta(\alpha_{Si\text{-}Fe}-\alpha_c)\Delta T(1-\nu_{RD})$$

Here, $\Delta T$=temperature difference (° C.) between secondary recrystallization annealing temperature and room temperature, $\alpha_{Si\text{-}Fe}$=thermal expansion coefficient of material, $\alpha_C$=thermal expansion coefficient of primary film, $E_c$=average value of primary film elastic value (Young's Modulus), $\delta$=thickness ratio of material to coating layer, and $\nu_{RD}$=Poisson's ratio in rolling direction.

Referring to Formula, a tensional stress improving coefficient by the primary film may be a thickness of the primary film or a difference of thermal expansion coefficients between the substrate and the film, and when the thickness of the film is increased, a stacking factor becomes worse, so the tensional stress may be increased by increasing the difference of thermal expansion coefficients between the substrate and the coating agent. However, as the annealing separator is limited to the magnesium oxide, there is a limit in increasing the difference of thermal expansion coefficients or improving the film tension by increasing the film elastic value (Young's Modulus).

In an embodiment of the present invention, to overcome the limit of the physical property of pure forsterite, a metal hydroxide containing at least one of a nickel hydroxide and a cobalt hydroxide that are reactive materials in addition to the magnesium oxide (MgO) is added to diffuse the substrate during a high-temperature annealing process, and it reacts with Fe existing on the diffused surface of the substrate to form at least one composite material from among Fe—Ni, Fe—Co, and Fe—Ni—Co, and thereby induces a permalloy forming effect that the conventional electrical steel sheet does not have. The permalloy may ultimately support magnetization with ease, and it ultimately reduces the iron loss of the material by this effect.

The annealing separator composition according to an embodiment of the present invention will now be described in detail for respective components.

In an embodiment of the present invention, the annealing separator composition contains 100 parts by weight of at least one of the magnesium oxide and the magnesium hydroxide. In an embodiment of the present invention, the annealing separator composition may have a slurry form so that it may be easily applied to a surface of the grain-oriented electrical steel sheet substrate. When water is included as a solvent of slurry, the magnesium oxide is easily dissolved in the water and it may exist in the magnesium hydroxide form. Therefore, in an embodiment of the present invention, the magnesium oxide and the magnesium hydroxide are considered as a single component. The inclusion of at least one of the magnesium oxide and the magnesium hydroxide at 100 parts by weight signifies that the annealing separator composition contains 100 parts by weight of the magnesium oxide when it contains the magnesium oxide, it contains 100 parts by weight of the magnesium hydroxide when it contains the magnesium hydroxide, and it contains 100 parts by weight of a sum of the magnesium oxide and the magnesium hydroxide when it contains the magnesium oxide and the magnesium hydroxide.

An activation level of the magnesium oxide may be 400 to 3000 seconds. When the activation level of the magnesium oxide is very large, a spinel-based oxide ($MgO \cdot Al_2O_3$) may remain on the surface after secondary recrystallization annealing is performed. When the activation level of the magnesium oxide is very small, it may not react with the oxidation layer and may fail to form a film. Therefore, the activation level of the magnesium oxide may be adjusted with the above-noted range. In this instance, the activation level represents capability for powder of MgO to chemically react to another component. The activation level is measured by a time for the MgO to completely neutralize a predetermined amount of a citric acid solution. When the activation level is high, the neutralization time may be short, and when the activation level is low, it may be long. In detail, the activation level is measured as the time for the solution to be changed to pink from white when 2 g of MgO is input to the 100 ml of the 0.4 N citric acid solution to which 2 ml of a 1% phenolphthalein reagent is added at the temperature of 30° C. and is stirred.

In an embodiment of the present invention, the annealing separator composition includes 30 to 250 parts by weight of the metal hydroxide containing at least one of the nickel hydroxide and the cobalt hydroxide. In an embodiment of the present invention, it is introduced to the annealing separator composition while having a reactive hydroxy group (—OH) in the nickel or cobalt composite. Sizes of atoms of the nickel hydroxide or the cobalt hydroxide are known to be slightly bigger than that of the magnesium oxide that is the major component of the annealing separator, and hence, when the nickel hydroxide or the cobalt hydroxide is diffused to an oxidation layer positioned on the surface of the material competitively with the magnesium oxide in the secondary recrystallization annealing, its diffusion speed is slightly slower compared to the magnesium oxide. In this case, the Mg dissociated from the magnesium oxide reacts to a silica oxide positioned on the surface of the material to form a composite material of Mg—Si, that is, forsterite, and the nickel or the cobalt reacts to the iron (Fe) positioned on the surface of the material to form a composite material of Fe—Ni or Fe—Ni—Co.

Therefore, in an embodiment of the present invention, the diffused nickel and cobalt reacts to the iron on the surface of the substrate to form a composite material of Fe—Ni, Fe—Co, or Fe—Ni—Co, and resultantly induces a permalloy forming effect. The permalloy may ultimately support magnetization with ease, and it ultimately reduces the iron loss of the material by this effect.

Differing from the above-described nickel hydroxide or cobalt hydroxide, the general metal hydroxide, particularly an aluminum hydroxide, has an excellent reaction to a $SiO_2$ or MgO-based oxide to easily form a composite material of Al—Si, Al—Mg, or Al—Si—Mg, and the composite material formed in this way reduces the thermal expansion coefficient of the primary film of the grain-oriented electrical steel sheet or improves the elastic coefficient to ultimately improve the film tension. On the contrary, it has low reactivity with the oxide of Fe so the composite material such as Fe—Al is not easily formed, and even when the Fe—Al is formed, it does not substantially support easing of magnetization, differing from the composite material of Fe—Ni, Fe—Co, or Fe—Ni—Co. As a result, when a general metal hydroxide except for the nickel hydroxide or the cobalt hydroxide is added, its influence is not large with respect to the improvement of the radio-frequency iron loss.

The metal hydroxide including at least one of the nickel hydroxide and the cobalt hydroxide is included at 30 to 250 parts by weight, regarding 100 parts by weight of at least one of the magnesium oxide and the magnesium hydroxide. When a very small amount of the metal hydroxide is contained, the effect caused by the addition of the metal hydroxide may be insufficiently obtained. When a very large amount of the metal hydroxide is contained, a coating property of the annealing separator composition may be degraded. Therefore, the metal hydroxide may be included with the above-noted range. In detail, 40 to 200 parts by weight of the metal hydroxide may be included. In detail, 50 to 150 parts by weight of the metal hydroxide may be included.

The metal hydroxide may include at least one of the nickel hydroxide and the cobalt hydroxide. That is, the metal hydroxide may include a nickel hydroxide, may include a cobalt hydroxide, or may include a nickel hydroxide and a cobalt hydroxide. When including a nickel hydroxide, it may include 30 to 250 parts by weight of the nickel hydroxide. When including a cobalt hydroxide, it may include 30 to 250 parts by weight of the cobalt hydroxide. When including a nickel hydroxide and a cobalt hydroxide, it may include 30 to 250 parts by weight of the sum of the nickel hydroxide and the cobalt hydroxide. In detail, it may include 30 to 150 parts by weight of the nickel hydroxide and 30 to 150 parts by weight of the cobalt hydroxide.

An average particle size of the metal hydroxide may be 0.01 to 80 μm. When the average particle size is very much small, diffusion may be mainly generated, and it may be difficult to form a composite material of at least one of Fe—Ni, Fe—Co, or Fe—Ni—Co caused by a reaction in the film. When the average particle size is very large, diffusion to the substrate may be difficult, and an improving effect of the film tension may be substantially reduced.

When including a nickel hydroxide and a cobalt hydroxide, the average particle size of the metal hydroxide may be 0.01 to 80 μm. That is, when the average particle diameter of the nickel hydroxide or the cobalt hydroxide digresses from the range, and the average particle diameter of the entire metal hydroxide satisfies the range, this is considered to be included in the range of the present invention. In detail, when including a nickel hydroxide and a cobalt hydroxide, the average particle size of the nickel hydroxide may be 0.01 to 80 μm, and the average particle size of the cobalt hydroxide may be 0.01 to 80 μm.

The annealing separator composition for a grain-oriented electrical steel sheet may further include 1 to 10 parts by weight of a ceramic powder for 100 parts by weight of at least one of the magnesium oxide and the magnesium hydroxide. The ceramic powder may be at least one of $Al_2O_3$, $SiO_2$, $TiO_2$, and $ZrO_2$. When it further includes an appropriate amount of the ceramic powder, an insulating characteristic of the film may be further improved. In detail, it may further include $TiO_2$ as the ceramic powder.

The annealing separator composition may further include a solvent so as to uniformly disperse and easily apply solids. Water or alcohol may be used as the solvent, and it may include 50 to 500 parts by weight thereof for 100 parts by weight of at least one of the magnesium oxide and the magnesium hydroxide. The annealing separator composition may have a slurry form.

Regarding the grain-oriented electrical steel sheet 100 according to an embodiment of the present invention, a film 20 including a composite material of at least one of Fe—Ni, Fe—Co, and Fe—Ni—Co is formed on one side or respective sides of the grain-oriented electrical steel sheet substrate 10. FIG. 1 shows a lateral cross-sectional view of a grain-oriented electrical steel sheet according to an embodiment of the present invention. FIG. 1 shows a case in which a film 20 is formed on an upper side of a grain-oriented electrical steel sheet substrate 10.

As described above, an appropriate amount of the magnesium oxide/hydroxide and the nickel/cobalt hydroxide is added into the annealing separator composition, so the film 20 according to an embodiment of the present invention includes at least one composite material of the Fe—Ni, Fe—Co, and Fe—Ni—Co. As it includes at least one composite material of Fe—Ni, Fe—Co, and Fe—Ni—Co, so it reduces the thermal expansion coefficient and increases the film tension, compared to the conventional forsterite. Further, the iron loss of the grain-oriented electrical steel sheet 100, particularly the radio-frequency iron loss, is improved by inducing the permalloy forming effect. This has already been described, and no repeated descriptions will be provided.

The film 20 may further include a composite material of Mg—Si, a composite material of Al—Mg, and a composite material of Al—Si, in addition to the above-noted composite materials.

The average particle diameter of at least one composite material of Fe—Ni, Fe—Co, and Fe—Ni—Co may be 1 to 100 nm with respect to the cross-section of the steel sheet 100 in a thickness direction (z direction). The cross-section in the thickness direction (z direction) represents all the cross-sections including a rolling side in a normal direction (ND direction), and in detail, it may be a vertical side (RD side) in the rolling direction. In this instance, the particle diameter indicates, assuming a circle that has the same area as an area occupied by the composite material, a diameter of the same circle. When the average particle diameter of the composite material is very small, the intended permalloy forming effect may be insufficient. When the average particle diameter of the composite material is very large, the film tension may be degraded. In detail, the average particle diameter of the composite material may be 5 to 30 nm.

Regarding the cross-section of the steel sheet in the thickness direction, the occupying area of at least one composite material of Fe—Ni, Fe—Co, and Fe—Ni—Co for the film area may be 0.1 to 10%. When the occupying area of the composite material is very small, the intended permalloy forming effect may be insufficient. When the occupying area of the composite material is very large, the film tension may be degraded. In detail, the occupying area of the composite material may be 0.5 to 5%.

A content of at least one composite material of Fe—Ni, Fe—Co, and Fe—Ni—Co may be 0.1 to 40 wt %. When the content of the composite material is very small, the intended permalloy forming effect may be insufficient. When the content of the composite material is very large, the film tension may be degraded. In detail, the occupying area of the composite material may be 1 to 15 wt %.

Regarding the element composition in the film 20, the film may include 0.1 to 40 wt % of at least one of Ni and Co, 40 to 85 wt % of Mg, 0.1 to 40 wt % of Si, and 10 to 55 wt % of O, and Fe as a remainder. The above-noted element compositions of Ni, Co, Mg, Si, and Fe are originated from the component in the substrate and the component of the annealing separator. O may be permeated in the heat treatment process. Other impurity components such as carbon (C) may be further included.

The film 20 may have a thickness of 0.1 to 10 μm. When the film 20 is very thin, the film tension allowance ability is deteriorated to degrade the iron loss. When the film 20 is very large, an adhesion property of the film 20 may be degraded and may be peeled off. Therefore, the thickness of the film 20 may be controlled within the above-noted range. In detail, the thickness of the film 20 may be 0.8 to 6 μm.

The film 20 may further include a composite material of Mg—Si. In this instance, the composite material of Mg—Si may be forsterite ($Mg_2SiO_4$).

As shown in FIG. 1, an oxidation layer 11 may be formed in the substrate 10 from an interface of the film 20 and the substrate 10. The oxidation layer 11 includes 0.01 to 0.2 wt % of O, and it is distinguished from the other substrate 10 that include a lesser amount of O than the same.

As described above, in an embodiment of the present invention, the metal hydroxide is added to the annealing separator composition, so the nickel and the cobalt are diffused to the oxidation layer 11 to thus form a composite material of at least one of Fe—Ni, Fe—Co, and Fe—Ni—Co in the oxidation layer 11. At least one composite material of Fe—Ni, Fe—Co, and Fe—Ni—Co improves the iron loss, particularly the radio-frequency iron loss, through the permalloy effect in a like way of the composite material in the film 20.

In an embodiment of the present invention, the effects of the annealing separator composition and the film 20 are expressed irrespective of the component of the grain-oriented electrical steel sheet substrate 10. In addition, the component of the grain-oriented electrical steel sheet substrate 10 will now be described.

The grain-oriented electrical steel sheet substrate may include 2.0 to 7.0 wt % of silicon (Si), 0.020 to 0.040 wt % of aluminum (Al), 0.01 to 0.20 wt % of manganese (Mn), 0.01 to 0.15 wt % of phosphorus (P), equal to or less than 0.01 wt % of carbon (C) (excluding 0%), 0.005 to 0.05 wt % of N, and 0.01 to 0.15 wt % of antimony (Sb), tin (Sn), or a combination thereof, and the remainder may include Fe and other inevitable impurities. The descriptions on the respective components of the grain-oriented electrical steel sheet substrate 10 correspond to what is known in general, so no detailed descriptions will be provided.

A method for manufacturing a grain-oriented electrical steel sheet according to an embodiment of the present invention includes: preparing a steel slab; heating the steel slab; producing a hot rolled plate by hot rolling the heated steel slab; producing a cold-rolled steel sheet by cold rolling the hot rolled plate; performing primary recrystallization annealing on the cold-rolled steel sheet; applying an annealing separator on a surface of the steel sheet having undergone the primary recrystallization annealing; and performing secondary recrystallization annealing on the steel sheet on which an annealing separator is applied. The method for manufacturing a grain-oriented electrical steel sheet may further include other stages.

In S10, a steel slab is prepared.

The steel slab is heated. In this instance, the slab may be heated at a temperature of equal to or less than 1200° C. by a low temperature slab method.

The heated steel slab is hot rolled to produce a hot rolled plate. The produced hot rolled plate may be hot annealed.

The hot rolled plate is cold rolled to produce a cold-rolled steel sheet. In the present stage, the cold rolling may be performed once, or the cold rolling including a process annealing may be performed at least twice.

The cold-rolled steel sheet undergoes primary recrystallization annealing. The primary recrystallization annealing process may include simultaneously performing decarburization annealing and nitrification annealing on the cold-rolled steel sheet, or may include performing nitrification annealing after performing decarburization annealing.

An annealing separator is applied on the surface of the steel sheet having undergone the primary recrystallization annealing. The annealing separator has already been described in detail, so no repeated descriptions will be provided.

An applied amount of the annealing separator may be 6 to 20 g/m$^2$. When the applied amount of the annealing separator is very small, the film may not be fluently formed. When the applied amount of the annealing separator is very large, the amount may influence the secondary recrystallization. Therefore, the applied amount of the annealing separator may be adjustable within the above-noted range.

When the annealing separator is applied, drying may be further included. The drying temperature may be 300 to 700° C. When the temperature is very low, the annealing separator may not be easily dried. When the temperature is very high, this may influence the secondary recrystallization. Therefore, the drying temperature of the annealing separator may be adjustable within the above-noted range.

The steel sheet on which an annealing separator is applied undergoes secondary recrystallization annealing. A film 20 including forsterite of Mg—Si and a composite material of at least one of Fe—Ni, Fe—Co, and Fe—Ni—Co is formed on the surface by the annealing separator component and a silica reaction for the secondary recrystallization annealing.

Further, oxygen together with nickel and cobalt permeates into the substrate 10, and an oxidation layer 11 is formed.

The secondary recrystallization annealing may be performed at a temperature raising speed of 18 to 75° C./h in the temperature range of 700 to 950° C., and it may be performed at a temperature raising speed of 10 to 15° C./h in the temperature range of 950 to 1200° C. The film 20 may be fluently formed by adjusting the temperature raising speed within the above-noted range. The temperature raising process at 700 to 1200° C. may be performed in an atmosphere including 20 to 30 volume % of nitrogen and 70 to 80 volume % of hydrogen, and it may be performed in an atmosphere including 100 volume % of hydrogen after the temperature reaches 1200° C. The film 20 may be fluently formed by adjusting the atmosphere within the above-noted range.

The present invention will be described in detail according to an embodiment. However, the embodiment exemplifies the present invention, and the present invention is not limited thereto.

Embodiment

A steel slab including 3.2% of Si, 0.055% of C, 0.12% of Mn, 0.026% of Al, 0.0042% of N, and 0.0045% of S, and including 0.04% of Sn, 0.03% of Sb, 0.03% of P, Fe as a remainder, and inevitable impurities as wt % is produced.

The slab is heated for 220 minutes at 1150° C., and is hot rolled with the thickness of 2.8 mm to thus produce the hot rolled plate.

The hot rolled plate is heated up to 1120° C., it is maintained at 920° C. for 95 seconds, it is quenched in water and is pickled, and it is cold rolled with the thickness of 0.23 mm to thus produce the cold-rolled steel sheet.

The cold-rolled steel sheet is provided into a furnace maintained at 875° C., and it is maintained for 180 seconds at the atmosphere of a mixture of 74 volume % of hydrogen, 25 volume % of nitrogen, and 1 volume % of dry ammonia gas, and is then concurrently decarburized and nitrified.

An annealing separator produced by mixing 100 g of the magnesium oxide with the activation level of 500 seconds as an annealing separator composition, a solid mixture of the nickel hydroxide and the cobalt hydroxide with the amount summarized in Table 1, and 250 g of water is prepared.

10 g/m$^2$ of the annealing separator is applied, and secondary recrystallization annealing is performed on a coil. A primary cracking temperature during a secondary recrystallization annealing is set to be 700° C., a secondary cracking temperature is set to be 1200° C., and a temperature raising condition of a temperature raising section is set to be 45° C./h for a temperature section of 700 to 950° C. and is set to be 15° C./h for a temperature section of 950 to 1200° C. A cracking time at 1200° C. is set to be 15 hours. The atmosphere for the secondary recrystallization annealing is an atmosphere with a mixture of 25 volume % of nitrogen and 75 volume % of hydrogen up to 1200° C. and after the temperature reaches 1200° C., a furnace is maintained and is then cooled at the atmosphere of 100 volume % of hydrogen.

Table 1 is a summary of components of an annealing separator applied to the present invention. Table 2 shows a summary of tensions, adhesion properties, iron losses, magnetic flux densities, and iron loss improving rates obtained after applying an annealing separator produced as in Table 1 to a specimen and performing secondary recrystallization annealing.

Further, the film tension is found by removing a coating on one side of the specimen of which respective sides are coated, measuring a curvature radius (H) of the generated specimen, and substituting the value to the next equation.

$$\delta_{Exp} = \frac{E_c}{1 - \nu_{RD}} \times \frac{T^2}{3t} \times \frac{2H}{l^2}$$

$E_c$=a film elastic (Young's Modulus) value, $\nu_{RD}$=a Poisson's ratio in the rolling direction, T: a thickness before a coating, t: a thickness after a coating, l: specimen length, and H: curvature radius.

Further, the adhesion property shows the specimen as a minimum circular arc diameter without film peeling when it is bent by 180° while contacting a 10 to 100 mm of a circular arc.

The iron loss and the magnetic flux density are measured by using a single sheet measuring method, and the iron loss ($W_{17/50}$) represents a power loss generated when a magnetic field with a frequency of 50 Hz is magnetized with an alternate current (AC) up to 1.7 Tesla. The iron loss (W10/400) represents a power loss shown when the magnetic field with the frequency of 400 Hz is magnetized with the alternate current (AC) up to 1.0 Tesla. The iron loss (W5/1000) indicates a power loss generated when the magnetic field with the frequency of 1000 Hz is magnetized with the alternate current (AC) up to 0.5 Tesla.

A magnetic flux density $B_8$ represents a magnetic flux density value flowing to the electrical steel sheet when a current of 800 Nm flows to a coil wrapping the electrical steel sheet.

The iron loss improving rate is calculated as ((conventional material iron loss−embodiment iron loss)/conventional material iron loss)×100 with reference to a conventional example using an annealing separator of MgO.

TABLE 1

| | | Nickel hydroxide | | Cobalt hydroxide | | | | |
|---|---|---|---|---|---|---|---|---|
| Specimen number | Magnesium oxide (g) | Dose (g) | average particle diameter (μm) | Dose (g) | Average particle diameter (μm) | Titanium oxide (g) | Pure water (g) | Notes |
| 1 | 100 | 40 | 0.05 | — | — | 2.5 | 400 | Embodiment 1 |
| 2 | 100 | 100 | 0.05 | — | — | 2.5 | 400 | Embodiment 2 |
| 3 | 100 | 200 | 0.05 | — | — | 2.5 | 400 | Embodiment 3 |
| 4 | 100 | 40 | 10 | — | — | 2.5 | 400 | Embodiment 4 |
| 5 | 100 | 100 | 10 | — | — | 2.5 | 400 | Embodiment 5 |
| 6 | 100 | 200 | 10 | — | — | 2.5 | 400 | Embodiment 6 |

TABLE 1-continued

| Specimen number | Magnesium oxide (g) | Nickel hydroxide Dose (g) | Nickel hydroxide average particle diameter (μm) | Cobalt hydroxide Dose (g) | Cobalt hydroxide Average particle diameter (μm) | Titanium oxide (g) | Pure water (g) | Notes |
|---|---|---|---|---|---|---|---|---|
| 7 | 100 | 40 | 100 | — | — | 2.5 | 400 | Comparative material 1 |
| 8 | 100 | 100 | 100 | — | — | 2.5 | 400 | Comparative material 2 |
| 9 | 100 | 200 | 100 | | | 2.5 | 400 | Comparative material 3 |
| 10 | 100 | 100 | 10 | 25 | 0.05 | 2.5 | 400 | Embodiment 7 |
| 11 | 100 | 100 | 10 | 50 | 0.05 | 2.5 | 400 | Embodiment 8 |
| 12 | 100 | 100 | 10 | 25 | 10 | 2.5 | 400 | Embodiment 9 |
| 13 | 100 | 100 | 10 | 50 | 10 | 2.5 | 400 | Embodiment 10 |
| 14 | 100 | 100 | 100 | 50 | 100 | 2.5 | 400 | Comparative material 4 |
| 15 | 100 | — | — | 50 | 10 | 2.5 | 400 | Embodiment 11 |
| 16 | 100 | 20 | 100 | — | — | 2.5 | 400 | Comparative material 5 |
| 17 | 100 | Aluminum hydoxide (100 g, 100 μm) | | — | — | 2.5 | 400 | Comparative material 6 |
| 18 | 100 | — | | | — | 5 | 250 | Conventional material |

TABLE 2

| Specimen number | Adhesion property (mmφ) | Magnetism: Iron loss (W 17/50, W/kg)/ improving rates (%) | Magnetism: iron loss (W 10/400, W/kg)/ improving rates (%) | Magnetism: iron loss (W 5/1000, W/kg)/ improving rates (%) | Magnetism: Magnetic flux density (B8, T) | Notes |
|---|---|---|---|---|---|---|
| 1 | 15 | 0.86/9.5 | 8.101/8.7 | 11.327/7.4 | 1.94 | Embodiment 1 |
| 2 | 20 | 0.88/7.4 | 8.25/7.1 | 11.47 6.2 | 1.93 | Embodiment 2 |
| 3 | 25 | 0.94/1.1 | 8.79/1.0 | 11.93/2.5 | 1.92 | Embodiment 3 |
| 4 | 20 | 0.89/6.3 | 8.3/6.5 | 11.59/5.3 | 1.93 | Embodiment 4 |
| 5 | 20 | 0.91/4.2 | 8.45/4.8 | 11.62/5.0 | 1.92 | Embodiment 5 |
| 6 | 25 | 0.92/3.2 | 8.49/4.4 | 11.75/3.9 | 1.92 | Embodiment 6 |
| 7 | 25 | 0.97/−2.1 | 9.08/−2.3 | 12.57/−2.8 | 1.91 | Comparative material 1 |
| 8 | 25 | 0.98/−3.2 | 9.19/−3.5 | 12.74/−4.1 | 1.91 | Comparative material 2 |
| 9 | 25 | 1.00/−5.2 | 9.46/−6.6 | 13.11/−7.2 | 1.91 | Comparative material 3 |
| 10 | 15 | 0.83/12.6 | 7.95/10.4 | 11.01/10.0 | 1.94 | Embodiment 7 |
| 11 | 15 | 0.82/13.7 | 7.780/10.9 | 10.902/10.9 | 1.93 | Embodiment 8 |
| 12 | 15 | 0.85/10.5 | 8.05/9.3 | 11.12/9.1 | 1.94 | Embodiment 9 |
| 13 | 15 | 0.86/9.5 | 8.08/9.0 | 11.21/8.4 | 1.93 | Embodiment 10 |
| 14 | 25 | 0.95/0 | 8.86/0.2 | 12.19/0.4 | 1.91 | Comparative material 4 |
| 15 | 25 | 0.89/6.3 | 8.3/6.5 | 11.62/5 | 1.92 | Embodiment 11 |
| 16 | 25 | 0.89/6.3 | 8.78/1.1 | 12.11/1.0 | 1.93 | Comparative material 5 |
| 17 | 25 | 0.95/0 | 8.92/−0.5 | 12.31/−0.6 | 1.92 | Comparative material 6 |
| 18 | 25 | 0.95 | 8.877 | 12.233 | 1.92 | Conventional material |

As expressed in Table 1 and Table 2, it is found that, when an appropriate amount of the nickel hydroxide and the cobalt hydroxide with adequate particle diameters is added to the annealing separator, the magnetism, particularly the radio-frequency iron loss, is improved, compared to the case in which the same is no added thereto.

It is found from the comparative material 1 to the comparative material 4 that the nickel hydroxide and the cobalt hydroxide with a very large average particle diameter are used so the nickel and the cobalt are not appropriately diffused into the substrate, and the magnetism becomes relatively degraded.

It is found from the comparative material 5 that a small amount of the nickel hydroxide and the cobalt hydroxide is added and the magnetism is relatively degraded.

It is found from the comparative material 6 that the iron loss (W17/50) is slightly improved by the addition of the aluminum hydroxide, and the radio-frequency iron losses (W10/400 and W5/1000) are degraded.

Figure 2:
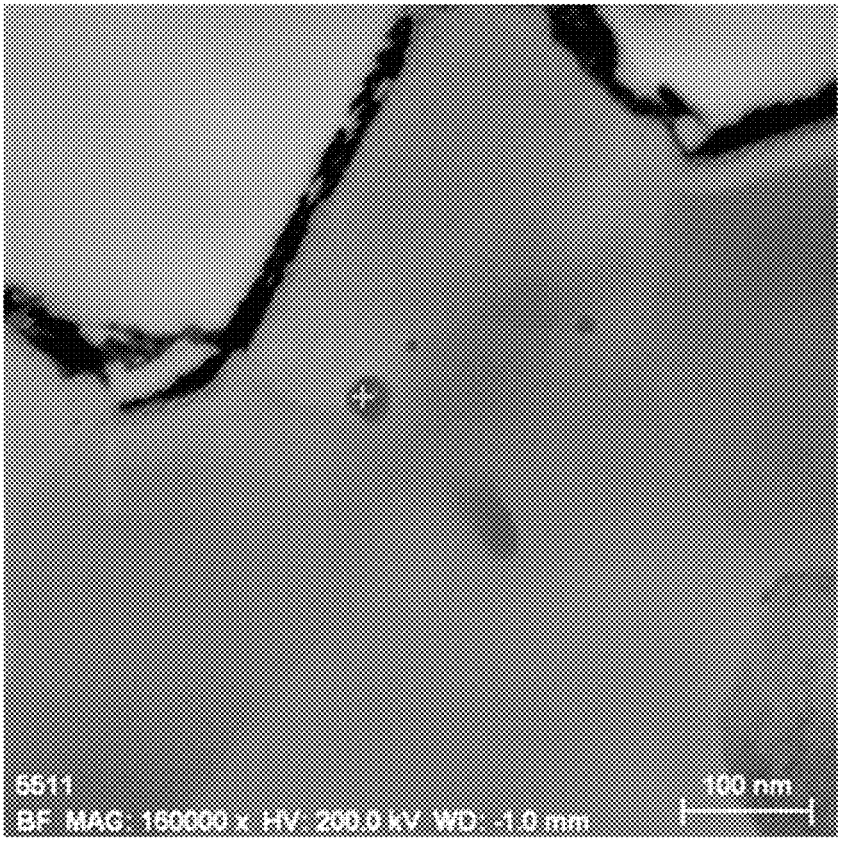
FIG. 2 shows results of an analysis on a film of a grain-oriented electrical steel sheet manufactured according to an embodiment 5 by use of a focus ion beam-scanning electron microscope (FIB-SEM).

FIG. 2 shows results of an analysis on a film of a grain-oriented electrical steel sheet manufactured according to an embodiment 5 by use of a focus ion beam-scanning electron microscope (FIB-SEM). As shown in FIG. 2, cross-sections of the composite material that appears to be Fe—Ni are found in the middle of the film. An average particle diameter of the composite material of Fe—Ni is analyzed to be 30 nm, and an area fraction is analyzed to be 5%.

Figure 3:
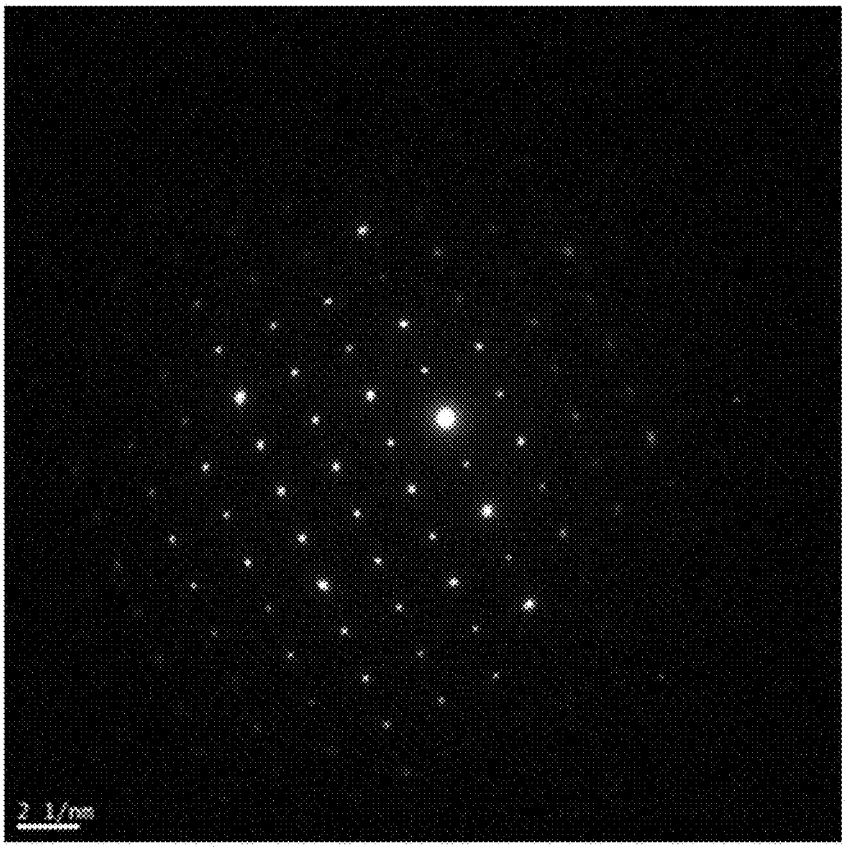
FIG. 3 shows results of an analysis of crystal of Fe—Ni in a film of a grain-oriented electrical steel sheet manufactured according to an embodiment 5 by use of a transmission electron microscope (TEM).

FIG. 3 shows results of an analysis of crystal of Fe—Ni in a film of a grain-oriented electrical steel sheet manufactured according to an embodiment 5 by use of a transmission electron microscope (TEM). As shown in FIG. 3, it is found that Fe—Ni is formed as a crystalline compound. As described in an embodiment of the present invention, it is found that the nickel hydroxide added as annealing separator is diffused to the oxidation layer on the surface and reacts to Fe to form a crystalline composite material of Fe—Ni.

Figure 4:
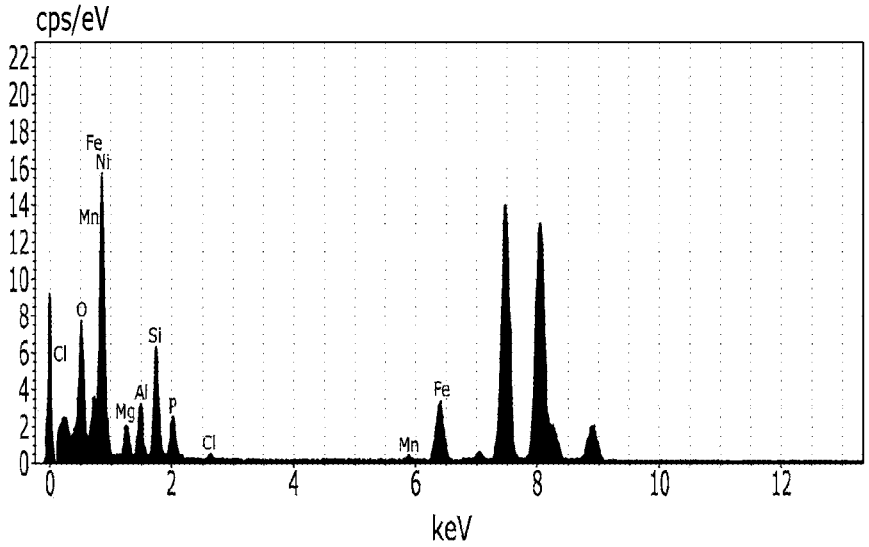
FIG. 4 shows result of Fe—Ni in a film of a grain-oriented electrical steel sheet manufactured according to an embodiment 5 by use of an electron probe micro-analysis (EPMA).

FIG. 4 shows result of Fe—Ni in a film of a grain-oriented electrical steel sheet manufactured according to an embodiment 5 by use of an electron probe micro-analysis (EPMA). As shown in FIG. 4, it is found that 5% of Ni, 40% of Mg, 20% of Si, 30% of O, and 5% of Fe are contained in the film as wt %.

Resultantly, it is found that the nickel hydroxide and the cobalt hydroxide added into the annealing separator generates the composite material of Fe—Ni together with the magnesium oxide to thereby improve the magnetism in comparison to the conventional forsterite film.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims. Therefore, the embodiments described above are only examples and should not be construed as being limitative in any respects.

DESCRIPTION OF SYMBOLS

100: grain-oriented electrical steel sheet 10: grain-oriented electrical steel sheet substrate
11: oxidation layer 20: film

The invention claimed is:

1. An annealing separator composition for a grain-oriented electrical steel sheet, comprising:
100 parts by weight of at least one of a magnesium oxide and a magnesium hydroxide; and
30 to 250 parts by weight of a metal hydroxide including a nickel hydroxide and a cobalt hydroxide,
wherein an average particle diameter of the metal hydroxide is 0.01 to 80 μm,
wherein the metal hydroxide includes 30 to 150 parts by weight of the nickel hydroxide and 30 to 150 parts by weight of the cobalt hydroxide.

2. The annealing separator composition of claim 1, further comprising 1 to 10 parts by weight of a ceramic powder.

3. The annealing separator composition of claim 2, wherein the ceramic powder is at least one of $Al_2O_3$, $SiO_2$, $TiO_2$, and $ZrO_2$.

4. The annealing separator composition of claim 1, further comprising 50 to 500 parts by weight of a solvent.

5. The annealing separator composition of claim 4, further comprising
1 to 10 parts by weight of a ceramic powder.

6. The annealing separator composition of claim 5, wherein the ceramic powder is at least one of $Al_2O_3$, $SiO_2$, $TiO_2$, and $ZrO_2$.

* * * * *